US011555161B2

(12) United States Patent
Yamamoto et al.

(10) Patent No.: US 11,555,161 B2
(45) **Date of Patent: *Jan. 17, 2023**

(54) GREASE COMPOSITION FOR METAL-RESIN LUBRICATION

(71) Applicant: MINEBEA MITSUMI Inc., Nagano (JP)

(72) Inventors: Daiki Yamamoto, Nagano (JP); Yusuke Asai, Nagano (JP); Motojiro Tsuna, Nagano (JP)

(73) Assignee: MINEBEA MITSUMI Inc., Nagano (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/654,303

(22) Filed: Mar. 10, 2022

(65) Prior Publication Data

US 2022/0306963 A1 Sep. 29, 2022

(30) Foreign Application Priority Data

Mar. 26, 2021 (JP) ..... JP2021-053851

(51) Int. Cl.
*C10M 169/00* (2006.01)
*C10M 107/38* (2006.01)
(Continued)

(52) U.S. Cl.
CPC ..... *C10M 169/00* (2013.01); *C10M 107/02* (2013.01); *C10M 107/38* (2013.01);
(Continued)

(58) Field of Classification Search
CPC ..... C10M 169/00; C10M 107/02; C10M 107/38; C10M 117/04; C10M 119/22; C10M 123/04; C10M 137/04; C10M 2205/0206; C10M 2207/1285; C10M 2213/0623; C10M 2213/0626; C10M 2223/041; C10M 111/04; C10M 169/06; C10M 2205/0285; C10M 2213/043;
(Continued)

(56) References Cited

U.S. PATENT DOCUMENTS 5,132,446 A * 7/1992 Tohzuka ..... C10M 169/04 558/186
6,541,430 B1 * 4/2003 Beatty ..... C07F 9/1651 508/421
(Continued)

FOREIGN PATENT DOCUMENTS

JP 2016-139589 A 8/2016

*Primary Examiner* — Pamela H Weiss
(74) *Attorney, Agent, or Firm* — Pearne & Gordon LLP

(57) ABSTRACT

A grease composition for resin lubrication, the grease composition to be applied to a sliding surface made of resin, the grease composition containing: a fluorine-based base oil (a kinematic viscosity at 40° C. of 300 $mm^2/s$ or higher) and a synthetic hydrocarbon oil as base oils; a fluorine-based thickener, and a lithium soap thickener or a lithium complex soap thickener as thickeners; and a fluorine-based surfactant and an extreme pressure additive as additives; and a resin sliding member (slide switch) having a sliding surface made of resin, the sliding surface provided by application with the grease composition.

18 Claims, 9 Drawing Sheets

(51) Int. Cl.

| | |
|---|---|
| ***C10M 107/02*** | (2006.01) |
| ***C10M 119/22*** | (2006.01) |
| ***C10M 117/04*** | (2006.01) |
| ***C10M 123/04*** | (2006.01) |
| ***C10M 137/04*** | (2006.01) |
| ***C10N 50/10*** | (2006.01) |
| ***C10N 20/02*** | (2006.01) |
| ***C10N 30/06*** | (2006.01) |
| ***C10N 40/04*** | (2006.01) |

(52) U.S. Cl.
CPC ..... *C10M 117/04* (2013.01); *C10M 119/22* (2013.01); *C10M 123/04* (2013.01); *C10M 137/04* (2013.01); *C10M 2205/0206* (2013.01); *C10M 2207/1285* (2013.01); *C10M 2213/0623* (2013.01); *C10M 2213/0626* (2013.01); *C10M 2223/041* (2013.01); *C10N 2020/02* (2013.01); *C10N 2030/06* (2013.01); *C10N 2040/04* (2013.01); *C10N 2050/10* (2013.01)

(58) Field of Classification Search
CPC ..... C10M 2215/064; C10N 2020/02; C10N 2030/06; C10N 2040/04; C10N 2050/10
See application file for complete search history.

(56) References Cited

U.S. PATENT DOCUMENTS

| | | | | |
|---|---|---|---|---|
| 8,859,799 | B1 * | 10/2014 | Larichev | C07F 9/09 558/175 |
| 11,174,450 | B2 * | 11/2021 | Asai | C10M 169/00 |
| 2006/0258548 | A1 * | 11/2006 | Gouko | B29C 33/60 508/421 |
| 2010/0105584 | A1 * | 4/2010 | Avataneo | C08F 293/005 508/552 |
| 2011/0257053 | A1 * | 10/2011 | Akao | C10M 169/044 184/6.12 |
| 2015/0011446 | A1 * | 1/2015 | Baskaran | C10M 107/44 568/586 |
| 2019/0276763 | A1 * | 9/2019 | Asai | C10M 169/02 |
| 2020/0032157 | A1 * | 1/2020 | Asai | C10M 169/00 |

* cited by examiner

GREASE COMPOSITION FOR METAL-RESIN LUBRICATION

CROSS-REFERENCE TO RELATED APPLICATIONS

This application claims the benefit of priority to Japanese Patent Application Number 2021-053851 filed on Mar. 26, 2021. The entire contents of the above-identified application are hereby incorporated by reference.

TECHNICAL FIELD

The disclosure relates to a grease composition for resin lubrication and particularly relates to a grease composition for resin lubrication between metal and resin.

BACKGROUND

JP 2016-139589 A proposes a slide switch (resin sliding member) with improved waterproofing.

SUMMARY

When a sliding member having a sliding surface made of resin (hereinafter referred to as a resin sliding surface) is used in an environment where the resin sliding surface easily comes into contact with water, a grease composition applied to the sliding surface tends to be easily removed from the sliding surface. When the grease composition is removed from the resin sliding surface, this can cause a sharp increase in friction force and wear amount on the sliding surface and in turn may lead to negative impact including shortening the life of a product provided with the resin sliding surface. Thus, this leads to a desire for a grease capable of preventing friction and wear without being removed from the sliding surface even when the resin sliding member is used in an environment where contact with water is likely to occur, for example, in an underwater environment.

Furthermore, in recent years, in such a resin sliding member as described above, a sliding member where a mating surface facing the resin sliding surface is metal (i.e., a resin-metal sliding member) has been used, and such a use requires a grease capable of preventing friction and wear of the resin sliding surface as in the case of the sliding member where a mating surface facing the resin sliding surface facing is resin.

Objects of the disclosure are to provide a grease composition having excellent lubricity between resin and metal, and to provide a resin sliding member and a resin-metal sliding member capable of preventing friction and wear by application of the grease composition, thereby improving operability and extending product life.

An aspect of the disclosure is a grease composition for resin lubrication, the grease composition to be applied to a sliding surface made of resin, the grease composition containing:

- a fluorine-based base oil and a synthetic hydrocarbon oil;
- a fluorine-based thickener, and one of a lithium soap thickener or a lithium complex soap thickener;
- a fluorine-based surfactant; and
- an extreme pressure additive,
- wherein, the fluorine-based base oil has a kinematic viscosity at 40° C. of 300 $mm^2/s$ or higher.

The disclosure also relates to a sliding surface made of resin, the sliding surface provided by application with the grease composition for resin lubrication.

Furthermore, the disclosure relates to a resin-metal sliding member having:

- a sliding surface made of resin, the sliding surface provided by application with the grease composition for resin lubrication; and
- a metal mating surface facing the sliding surface.

BRIEF DESCRIPTION OF DRAWINGS

FIG. 1A is a cross-sectional view of the slide switch in a switched off state viewed from the front, and FIG. 1B is a cross-sectional view of the slide switch in a switched-on state viewed from the front.

FIG. 3A is a front view of the multistage gear system, and FIG. 3B is a side view (partially including a cross section) of the multistage gear system.

DESCRIPTION OF EMBODIMENTS

Figure 1A:
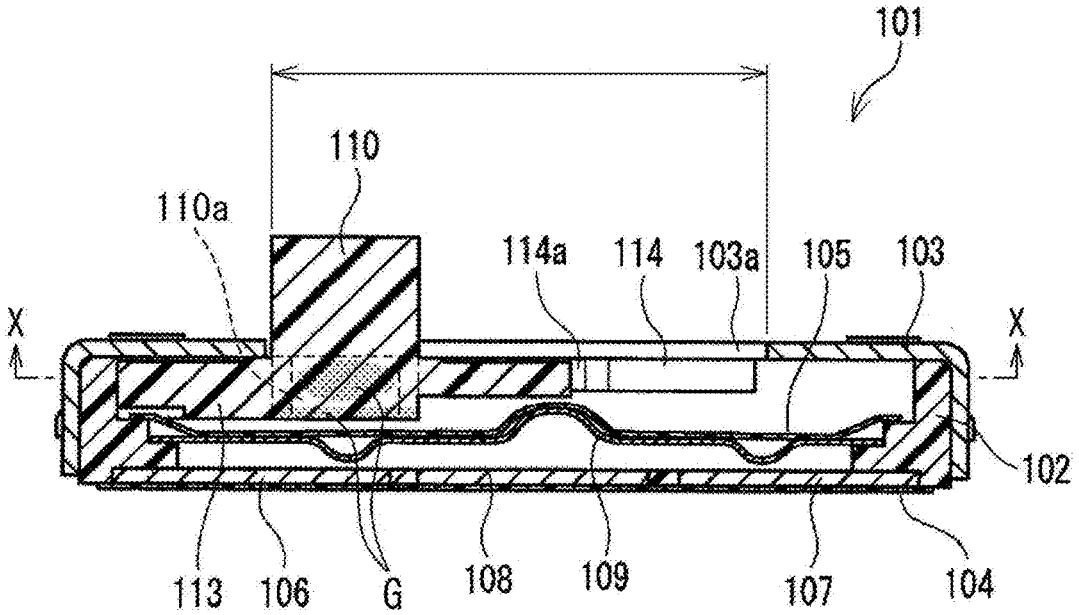
FIGS. 1A and 1B are schematic views illustrating a structure of an aspect of a sliding member (slide switch) of the disclosure.

As described above, use in an environment where contact with water is likely to occur, and for example, in an underwater environment or in an environment where condensation is likely to occur (hereinafter also referred to collectively as a water contact environment) poses a problem in that the grease is easily removed from the coating surface. For example, the slide switch disclosed in JP 2016-139589 A is provided with a waterproof sheet made of resin to increase waterproofing in view of possible use in a water contact environment, and as described later, the slide switch turns the switch on and off via this waterproof sheet. At this time, grease is used to improve the lubricity of the waterproof sheet and the slider and the lubricity of the slider and another contact surface. However, grease with poor adhesion can be removed even during use of the switch (implementation of on and off), and this can increase the friction force between the slider and the waterproof sheet or the like and can cause wear and damage to the waterproof sheet or the like. Consequently, this may lead to shortened life of the slide switch. In recent years, increasingly smaller switch members have further increased the load on the waterproof sheet. This increases the occurrence of a tear in the waterproof sheet or the like and leads to a concern that the life of the switch may be further shortened.

In addition, some slide switches have another contact surface sliding with respect to the slider (resin), and such a contact surface is, for example, a click spring (elastic member) made of resin. In addition to such a click spring made of resin, the click spring is made of metal in some slide switches. Grease used in the latter slide switch is desired to achieve not only lubricity between the above waterproof sheet (resin) and the slider (resin) but also good lubricity between the slider (resin) and the click spring (metal).

For the grease for resin lubrication, such as that of micro slide switches, fluorine-based grease has been used in the art. To improve the adhesion of the grease to the resin in the water contact environment described above, a mixture of a fluorine-based lubricant and a lithium soap grease used as a non-fluorine-based lubricant has been employed and studied to extend the life of a slide switch.

However, it is hard to say that the above mixture of a fluorine-based lubricant and a non-fluorine-based lubricant provides better lubrication between resin and metal than a fluorine-based lubricant used alone. Thus, this leads to a concern that using such a mixture in a switch having a sliding part where the mating surface facing the resin sliding surface (slider) is a metal (click spring) may deteriorate the operability (click feeling) of the slide switch.

One factor affecting the lubricity is considered to be the quality of mutual dispersibility in the above mixture. As shown in the results of examples described later, in comparison of microscopic observation photographs (FIGS. 6A and 6B) of a grease composition containing a fluorine-based surfactant (Example 2) and a grease composition containing no fluorine-based surfactant (Comparative Example 2), many aggregates with a size approximately of 20 to 30 μm is observed in the grease composition containing no surfactant. The presence of such aggregates is considered to lead to an increase in the friction coefficient at the sliding surface, and for example, for the lubricity between resin and metal, this is considered to deteriorate the switch operability. In addition, sliding under load in a state where the aggregates occur probably increases grease scraping from the sliding surface, and this can cause wear and damage to the waterproof sheet.

In an attempt to solve such problems, the present inventors found that a formulation of grease containing a fluorine-based base oil and a synthetic hydrocarbon oil as base oils, fluorine-based thickener and one of a lithium soap thickener or a lithium complex soap thickener as thickeners, and an extreme pressure additive, and containing especially a fluorine-based surfactant not only provides excellent lubricating properties of the grease in a water contact environment but also provides excellent lubricating properties especially between resin and metal.

A grease composition for resin lubrication according to the disclosure (hereinafter also referred to simply as a "grease composition") is characterized by being formed by combining specific base oils and specific thickeners and blending a fluorine-based surfactant to the combination as described later. This grease composition can impart excellent lubricating properties to the application point (sliding surface) not only at a mating surface made of resin but also especially at a mating surface made of metal. Hereinafter, the disclosure will be specifically described.

Resin Sliding Member and Resin-Metal Sliding Member

The resin sliding member and resin-metal sliding member to be provided by application with the grease composition for resin lubrication according to the disclosure are not particularly limited, and examples include slide switches, gear systems, and bearings.

The resin sliding member targeted by the disclosure is any sliding member having a sliding surface made of resin in at least a portion of the sliding member and is not particularly limited. In addition, the resin-metal sliding member targeted by the disclosure is any sliding member having a sliding surface made of resin and a metal mating surface facing the sliding surface and is not particularly limited. Thus, the resin sliding member and the resin-metal sliding member include not only slide switches, gear systems, and bearings but also various resin sliding members and resin-metal sliding members as described above, and these resin sliding members and resin-metal sliding members are also targets of the disclosure.

In addition, the resin sliding member of the disclosure has a sliding surface made of resin, the sliding surface provided by application with the grease composition for resin lubrication described later (a resin sliding surface where at least a portion of the sliding surface is covered with the grease composition for resin lubrication by coating with the grease composition or by contact with the grease composition by sealing).

Furthermore, the resin-metal sliding member of the disclosure has a sliding surface made of resin, the sliding surface provided by application with the grease composition for resin lubrication described later (a resin sliding surface where at least a portion of the sliding surface is covered with the grease composition for resin lubrication by coating with the grease composition or by contact with the grease composition by sealing) and a metal mating surface facing the sliding surface.

Each of preferred embodiments of the resin sliding member and the resin-metal sliding member will be described in detail below with reference to the accompanying drawings, but the disclosure is not limited by the following embodiments.

Slide Switch

Figure 1B:
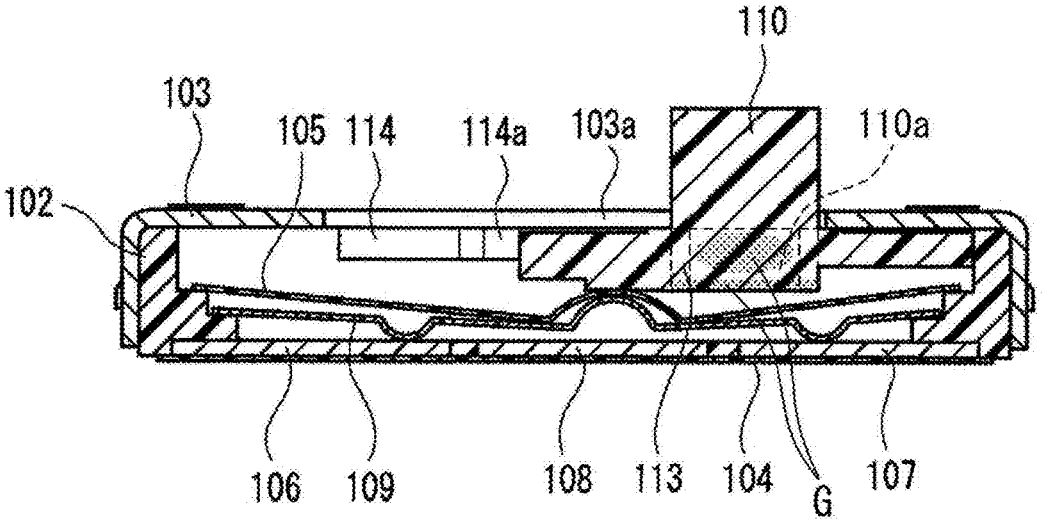
Figure 2:
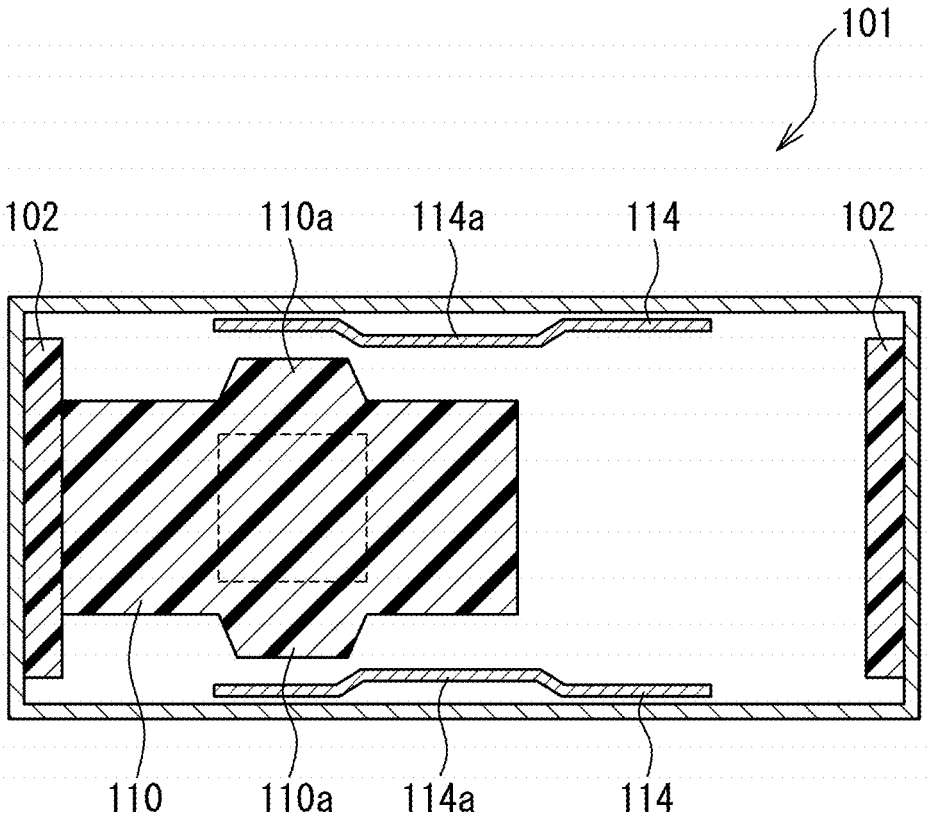
FIG. 2 is a schematic view illustrating a structure of an aspect of the sliding member (slide switch) of the disclosure, illustrating a cross-sectional view taken along the line X-X in FIG. 1A.

FIGS. 1A and 1B illustrate a cross section of a slide switch 101 of a preferred embodiment of the disclosure viewed from the front. In addition, a cross sectional view taken along the line X-X in FIG. 1A (a view of the slide switch 101 viewed from the top) described later is illustrated in FIG. 2.

In an example illustrated in FIGS. 1A and 1B (and FIG. 2), the slide switch 101 is provided with a housing 102, a cover 103, a first waterproof film 104, a second waterproof film 105, a first fixed contact 106, a second fixed contact 107, a third fixed contact 108, a movable contact 109, a slider 110, a contact operating part 113, and a click spring 114.

As illustrated in FIGS. 1A and 1B, the housing 102 and the cover 103 are combined to form a case. The housing 102 is formed of an insulating material, and the cover 103 is formed of a metal, such as stainless steel. The cover 103 may be formed of an insulating material.

The first waterproof film 104 and the second waterproof film 105 are provided to increase the waterproofing of the slide switch 101 as described later. As illustrated in FIGS. 1A and 1B, the first waterproof film 104 is mounted at an outer surface of the housing 102, and the second waterproof film 105 is mounted inside the housing 102.

In addition, the first fixed contact 106, the second fixed contact 107, and the third fixed contact 108 are fixed between the first waterproof film 104 and the second waterproof film 105 to the housing 102. The first fixed contact 106, the second fixed contact 107, and the third fixed contact 108 are separated from each other by the housing 102, electrically insulated, and are formed of a conductive material. Although not illustrated, the end portion of the first fixed contact 106, the end portion of the second fixed contact 107, and the end portion of the third fixed contact 108 are each exposed at the bottom of the housing 102 and are used as connection terminals with an external circuit.

The movable contact 109 is formed of a conductive material. As illustrated in FIGS. 1A and 1B, the movable contact 109 is displaceable between a separation position (on position, FIG. 1A) separated from the first fixed contact 106 and the second fixed contact 107, and a contact position (off position, FIG. 1B) in contact with the first fixed contact 106 and the second fixed contact 107. The movable contact 109 is formed of an elastic member configured to take the separation position in an unloaded state (FIG. 1A).

The slider 110 is formed of an insulating resin material. As illustrated in FIG. 1A, the slider 110 is supported inside the housing 102. The slider 110 is movable between the off position and the on position in the longitudinal direction of the housing 102 (in FIG. 1A, the range indicated by the double-pointed arrow is a movable range of the slider 110).

The cover 103 includes a slide groove 103*a* extending in the longitudinal direction of the housing 102, and the slide groove 103*a* is configured to guide the movement of the slider 110 between the off position and the on position.

In addition, the slider 110 is provided with the contact operating part 113. The contact operating part 113 is configured to displace the movable contact 109 from the separation position to the contact position via the second waterproof film 105 by moving the slider 110 from the off position to the on position.

FIG. 1B illustrates a state of the slider 110 moved from the state illustrated in FIG. 1A to the on position along the slide groove 103*a*. As the slider 110 moves, the contact operating part 113 provided at the slider 110 displaces the movable contact 109 via the second waterproof film 105. When the movable contact 109 comes into contact with the first fixed contact 106 and the second fixed contact 107, the first fixed contact 106 and the second fixed contact 107 are electrically connected via the movable contact 109.

To release the conduction state between the first fixed contact 106 and the second fixed contact 107, the above operation is performed in the reverse order. That is, the slider 110 is moved toward the off position along the slide groove 103*a* to release the pressing force at the movable contact 109 applied by the contact operating part 113. The movable contact 109 returns to the separation position by its elastic return force. That is, the contact state between the movable contact 109 and the first fixed contact 106 and the second fixed contact 107 is released.

According to the above configuration, the first fixed contact 106, the second fixed contact 107, and the movable contact 109 are arranged between the first waterproof film 104 and the second waterproof film 105. The separation and contact of the first fixed contact 106 and the second fixed contact 107 are performed by the contact operating part 113 provided at the slider 110 via the second waterproof film 105. Moisture can enter the housing 102 from the outside through the opening of the slide groove 103*a*.

In addition, the slide switch 101 includes a pair of click springs 114 (elastic members). Each click spring 114 includes a protruding part 114*a*. On the other hand, the slider 110 includes a pair of protruding parts 110*a*.

As illustrated in FIGS. 1A and 1B (and FIG. 2), when the slider 110 moves between the off position (FIG. 1A and FIG. 2) and the on position (FIG. 1B), each protruding part 110*a* of the slider 110, while elastically deforming the opposing click spring 114, displaces the protruding part 114*a* of the click spring 114 in the lateral direction of the housing 102 (the direction orthogonal to the paper surface of the page of FIGS. 1A and 1B as well as the upper and lower direction in the paper surface of the page of FIG. 2). When each protruding part 110*a* of the slider 110 passes through the protruding part 114*a* of the opposing click spring 114, the elastic return force of the click spring 114 assists the movement of the slider 110 to the on position or the off position, and the click feeling of the switch is given.

In the slide switch 101, the second waterproof film 105 is formed from a polyamide resin, such as nylon; or a polyphthalamide (PPA) resin material. In addition, the slider 110 can be formed from an insulating resin material, such as polyamide (PA), polyphenylene sulfide (PPS), or polyphthalamide (PPA). Furthermore, the click spring 114 is formed from the insulating material described above; a resin material having spring properties, such as a polycarbonate (PC), a polyacetal (POM), a poly(ether ether ketone) (PEEK), or a reinforced plastic; or a metal material having spring properties, such as a stainless steel, a carbon steel, or a special steel such as a carbon tool steel (cold rolled steel for springs).

In the slide switch 101 of the present aspect, a grease composition G for resin lubrication according to the disclosure is applied to the contact point of the contact operating part 113 in the slider 110 with the second waterproof film 105 (the lower part of the slider 110 is the resin sliding surface) and to the contact point of each protruding part 110*a* of the slider 110 and each protruding part 114*a* of the click spring 114 (each protruding part 110*a* of the slider 110 is the resin sliding surface). That is, the grease composition G for resin lubrication is applied to the resin sliding surface of the slide switch 101. In the slide switch 101, the grease composition G having excellent adhesion to the resin sliding surface described later even in an environment where water has entered the housing 102 from the slide groove 103*a*, and also having excellent lubricity of the grease itself is used. Thus, this prevents friction and wear in the slide switch 101 and extends product life.

Gear System

As an example of the gear system of the preferred embodiment of the disclosure, a multistage gear system provided to an actuator will be described.

The "multistage gear system" to be provided by application with the grease composition for resin lubrication according to the disclosure refers to a multistage gear system including gears where at least any of the gears is made of resin. The multistage gear system may be composed of coexisting gear made of resin and gear made of a material other than resin, such as, for example, a gear made of metal, or may be composed only of a gear made of resin. The disclosure includes an aspect of a gear system having a gear made of resin and a gear made of metal meshing with the gear made of resin.

In addition, the grease composition for resin lubrication described later is provided by application to a bearing part of the gear made of resin and to a meshing part of the gear made of resin and a gear made of resin or a material other than resin, and especially to a meshing part of the gear made of resin and a gear made of metal.

Figure 3A:
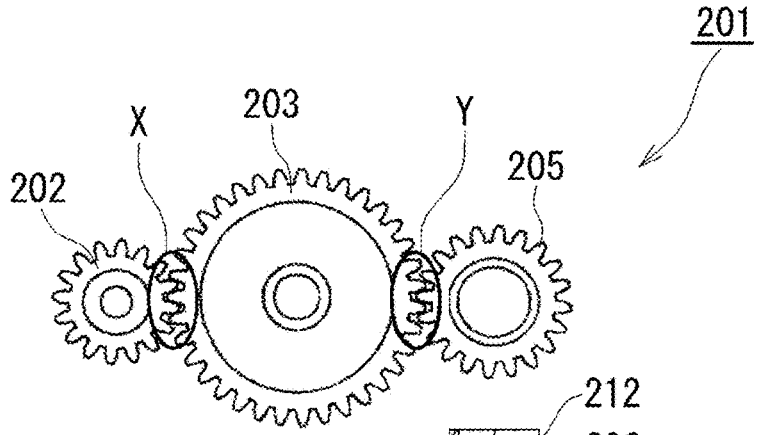
FIGS. 3A and 3B are schematic views illustrating a structure of an aspect of the sliding member (multistage gear system) of the disclosure.
Figure 3B:
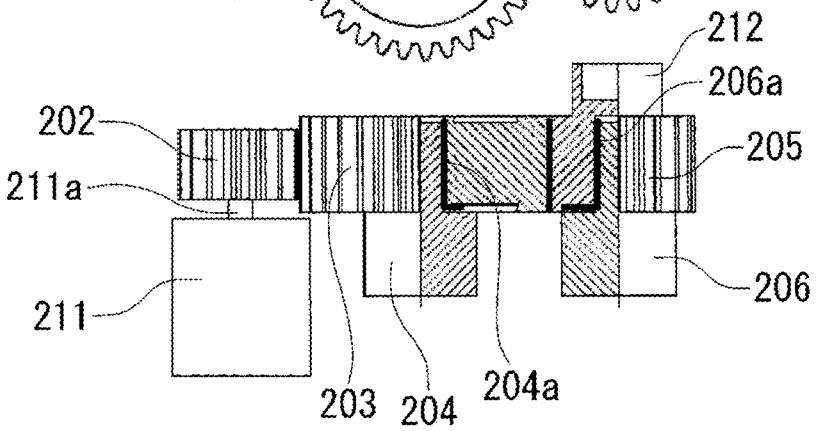

FIGS. 3A and 3B are schematic views of a multistage gear system 201 provided to an actuator; FIG. 3A is a front view of the multistage gear system 201, and FIG. 3B is a side view (partially including a cross section) of the multistage gear system 201. FIG. 3B also illustrates a motor 211, its output shaft 211*a*, and an actuator output shaft 212 in addition to the multistage gear system 201.

The multistage gear system 201 illustrated in FIGS. 3A and 3B includes a first-stage gear 202 integrally rotatably attached to the output shaft 211*a* of the motor 211, a second-stage gear 203 meshed with the first-stage gear 202, and a third-stage gear 205 meshed with the second-stage gear 203. In addition, FIG. 3B illustrates a shaft 204 of the second-stage gear 203 and a shaft 206 of the third-stage gear 205, and also illustrates the output shaft 212 of the actuator described above.

In the present embodiment, the grease composition for resin lubrication described later is applied to a meshing part X of the first-stage gear 202 and the second-stage gear 203, a meshing part Y of the second-stage gear 203 and the third-stage gear 205, a bearing part 204*a* of the second-stage gear 203, and a bearing part 206*a* of the third-stage gear 205 in FIGS. 3A and 3B.

In an embodiment, the first-stage gear 202 and the third-stage gear 205 in FIGS. 3A and 3B can be metal gears, and the second-stage gear 205 can be a resin gear.

In the multistage gear system 201 described above, the shafts constituting the system, that is, each shaft (204 and 206) of the multistage gear system, and the output shaft 202*a* of the motor and the output shaft 212 of the actuator may be either made of metal or made of resin, but for example, the configuration can be as follows.

For example, the output shaft 211*a* of the motor 211 is a rotating shaft made of metal. The output shaft 211*a* and the first-stage gear 202 are fixed, and the first-stage gear 202 rotates together with the output shaft 211*a*. Thus, no relatively rotating bearing part is present between the first-stage gear 202 and the output shaft 211*a*.

On the other hand, the shaft 204 of the second-stage gear 203 and the shaft 206 of the third-stage gear 205 are both made of resin and are fixed shafts. In addition, the second-stage gear 203 and the third-stage gear 205 rotate while sliding with respect to the respective fixed shafts. Thus, the grease composition for resin lubrication described later is applied to the bearing part 204*a* between the second-stage gear 203 and the shaft 204 (fixed shaft) of the second-stage gear, and to the bearing part 206*a* between the third-stage gear 205 and the shaft 206 (fixed shaft) of the third-stage gear in addition to the meshing parts X and Y of the gears meshing with each other.

Examples of the resin usable as the resin members constituting these gear systems (the gears and shafts of the gears) and the actuator (such as the output shaft of the motor, a base member, an outer member (case), and the output shaft of the actuator) provided with the gear system include polyethylenes (PEs), polypropylenes (PPs), ABS resins (ABSs), polyacetals (POMs), polyamides (PAs), polycarbonates (PCs), phenolic resins (PFs), poly(ethylene terephthalate)s (PETs), poly(butylene terephthalate)s (PBTs), poly(phenylene sulfide)s (PPSs), poly(ether sulfone)s (PESs), polyimides (PIs), and poly(ether ether ketone)s (PEEKs).

In addition, for the metal members constituting these gear systems, a metal material, such as a carbon steel, a chrome steel, a chromium-molybdenum alloy steel, or a stainless steel can be used.

The gear system of the present embodiment is suitably used in actuators used in in-vehicle air conditioning systems or the like. In in-vehicle air conditioning systems, the gear system is used in a wide range of −40° C. to 100° C., and use in these temperature cycles may cause condensation inside the actuator, and water droplets may adhere to the tooth surface and grease.

In addition, the gear system of the present embodiment is also suitably used for an actuator used, for example, in an automatic opening/closing device for a toilet seat and a toilet lid, and the like. In an automatic opening/closing device, such as one for a toilet seat, water may splash at the actuator during washing.

Even in a gear system used in such an environment where the gear system easily comes into contact with water, application of the grease composition for resin lubrication of the disclosure prevents friction and wear and extends the life of the product.

[Grease Composition For Resin Lubrication]

The grease composition for resin lubrication of the disclosure will be described.

Base Oil

In the grease composition for resin lubrication according to the present embodiment, a fluorine-based base oil and a synthetic hydrocarbon oil are used as base oils.

Examples of the fluorine-based base oil include those containing a perfluoropolyether (PFPE) as a main component. The PFPE is a compound represented by a general formula: $RfO(CF_2O)_p(C_2F_4O)_q(C_3F_6O)_rRf$, where Rf is a perfluoro lower alkyl group; and p, q, and r are integers.

The perfluoropolyether is broadly classified into a linear type and a side chain type, and the linear type has a lower temperature dependence of kinematic viscosity than the side chain type. This means that the linear type has a lower viscosity than the side chain type in a low temperature environment and a higher viscosity than the side chain type in a high temperature environment. For example, when the use in a high temperature environment is assumed, the viscosity in a high temperature environment is desirably high from the viewpoint of preventing the outflow of grease from the application point and the accompanying depletion, that is, the linear type perfluoropolyether is suitably used.

As a result of examining the configuration to satisfy the optimum friction coefficient value as an index of lubricating properties, the present inventors have found that the value of the kinematic viscosity of the fluorine-based base oil is also one of important factors in addition to the composition of the grease composition.

As shown in the results of examples described later, when the value of the kinematic viscosity of the fluorine-based base oil at 40° C. was changed (392 $mm^2/s$ (Example 5), 300 $mm^2/s$ (Example 8), and 200 $mm^2/s$ (Comparative Example 5)) in grease compositions containing specific base oils and thickeners, an extreme pressure additive and a fluorine-based surfactant, the grease composition exhibited a behavior where the value of the kinetic friction coefficient gradually increased with decrease in the value of the kinematic viscosity. In addition, the results confirmed that when the value of the kinematic viscosity was below 300 $mm^2/s$, the value of the kinetic friction coefficient exceeded 0.060.

As shown by the above results, in the grease composition for resin lubrication of the disclosure, the fluorine-based base oil has a kinematic viscosity at 40° C. preferably of 300 $mm^2/s$ or higher and particularly preferably of 390 $mm^2/s$ or higher.

Examples of the suitable synthetic hydrocarbon oil include normal paraffins; isoparaffins; polybutenes; polyisobutylenes; polyalphaolefins (PAOs), such as 1-decene oligomer, and cooligomer of 1-decene and ethylene.

The blending ratio of the above fluorine-based base oil and synthetic hydrocarbon oil is not particularly limited, but the ratio of the fluorine-based base oil to the synthetic hydrocarbon oil, for example, relative to a total amount of the base oils of 100 mass % can be from 99 to 5 mass %:from 1 to 95 mass %, for example, from 99 to 10 mass %:from 1 to 90 mass %, from 98 to 20 mass %:from 2 to 80 mass %, from 98 to 30 mass %:from 2 to 70 mass %, from 98 to 50 mass %:from 2 to 50 mass %, preferably from 98 to 65 mass %:from 2 to 35 mass %, or particularly from 98 to 70 mass %:from 2 to 30 mass %.

In addition, the proportion of the total base oils totaling the fluorine-based base oil and the synthetic hydrocarbon oil to the total mass of the grease composition of the disclosure can be from 60 to 90 mass %, for example, from 65 to 80 mass % or from 65 to 75 mass %.

Thickener

In the grease composition of the disclosure, a fluorine-based thickener and one of a lithium soap thickener or a lithium complex soap thickener are added as thickeners.

Fluorine-Based Thickener

The fluorine-based thickener is preferably a fluorine resin particle, and for example, a particle of a polytetrafluoroethylene (PTFE) is preferably used. The PTFE is a polymer of tetrafluoroethylene and is represented by a general formula: $[C_2F_4]_n$, where n is a degree of polymerization.

In addition, examples of the usable fluorine-based thickener include perfluoroethylene-propylene copolymers (FEPs), ethylene-tetrafluoroethylene copolymers (ETFEs), and tetrafluoroethylene-perfluoroalkyl vinyl ether copolymers (PFAs).

The size of the PTFE particle is not particularly limited, but for example, a polytetrafluoroethylene with an average particle size of 0.1 μm to 100 μm can be used. Furthermore, the shape of the PTFE particle is not particularly limited and may be spherical, polyhedral, needle-shaped, or the like.

The fluorine-based thickener is used at 1 to 40 mass %, for example at 10 to 30 mass %, or at 20 to 30 mass % relative to the total mass of the grease composition.

Lithium Soap Thickener and Lithium Complex Soap Thickener

In the disclosure, a lithium soap thickener is used in addition to the fluorine-based thickener described above.

A lithium salt of an aliphatic monocarboxylic acid can be used as the lithium soap thickener.

The aliphatic carboxylic acid may be any of a linear, branched, saturated, or unsaturated aliphatic carboxylic acid, and typically a fatty acid having approximately from 2 to 30 carbon atoms, for example, from 12 to 24 carbon atoms can be used. Specifically, examples include saturated fatty acids, such as butyric acid, caproic acid, caprylic acid, pelargonic acid, capric acid, lauric acid, myristic acid, palmitic acid, stearic acid, and behenic acid; and unsaturated fatty acids, such as oleic acid, linoleic acid, linolenic acid, and ricinoleic acid.

Among them, representative examples of the lithium soap thickener include lithium salts of stearic acid, lauric acid, and ricinoleic acid, and lithium salts of compounds obtained by replacing the acid with a hydroxy group.

In the disclosure, a lithium complex soap thickener may be used in place of the lithium soap thickener.

The lithium complex soap thickener is obtained by combining a higher fatty acid and a dibasic acid or an inorganic acid (such as boric acid) and has improved heat resistance compared to the lithium soap thickener.

The lithium complex soap thickener can be obtained, for example, by reacting lithium hydroxide with an aliphatic monocarboxylic acid having approximately from 12 to 24 carbon atoms and containing at least one hydroxy group, and an aliphatic dicarboxylic acid having approximately from 2 to 12 carbon atoms.

Examples of the aliphatic monocarboxylic acid having from 12 to 24 carbon atoms and containing at least one hydroxy group include hydroxylauric acid, hydroxypalmitic acid, hydroxystearic acid, hydroxyoleic acid, hydroxyarachidic acid, hydroxybehenic acid, and hydroxylignoceric acid.

In addition, examples of the aliphatic dicarboxylic acid having from 2 to 12 carbon atoms include oxalic acid, malonic acid, succinic acid, methylsuccinic acid, glutaric acid, adipic acid, pimelic acid, suberic acid, azelaic acid, sebacic acid, nonamethylenedicarboxylic acid, and decamethylenedicarboxylic acid.

These monocarboxylic acids and dicarboxylic acids may be used alone or as a mixture of two or more.

Representative examples of the lithium complex soap thickener include those obtained by reacting lithium hydroxide with hydroxystearic acid and azelaic acid in combination.

The lithium soap thickener or lithium complex soap thickener is used at 0.1 to 15 mass %, for example, at 0.2 to 5 mass % relative to the total mass of the grease composition.

The fluorine-based thickener and one of the lithium soap thickener or the lithium complex soap thickener can be blended to give a total amount (total amount of the thickeners) of 5 to 40 mass %, for example, of 10 to 30 mass %, preferably of 15 to 30 mass %, and particularly of 20 to 30 mass % relative to the total mass of the grease composition for resin lubrication.

In the disclosure, when a total mass of the fluorine-based base oil, the synthetic hydrocarbon oil, the fluorine-based thickener, and one of the lithium soap thickener or the lithium complex soap thickener is 100, a mass ratio [A]:[B] of a total amount [A] of the fluorine-based base oil and the fluorine-based thickener to a total amount [B] of the synthetic hydrocarbon oil and one of the lithium soap thickener or the lithium complex soap thickener can be from 99 to 60:from 1 to 40, for example, from 98 to 70:from 2 to 30, from 98 to 75:from 2 to 25, from 98 to 80:from 2 to 20, from 98 to 85:from 2 to 15, or from 98 to 90:from 2 to 10.

Fluorine-Based Surfactant

The grease for resin lubrication of the disclosure contains a fluorine-based surfactant.

Examples of the fluorine-based surfactant include fluorine-containing sulfonate esters, fluorine-containing sulfate esters, fluorine-containing phosphate esters, fluorine-containing alkyl sulfonic acids, and fluorine-containing alkyl carboxylic acids, and for example, a fluorine-containing phosphate ester can be used.

As a result of examining the configuration to satisfy the optimum friction coefficient value as an index of lubricating properties, especially the configuration to satisfy the optimum friction coefficient value between resin and metal, the present inventors have found that blending a fluorine-based surfactant is crucial and the blending amount of the fluorine-based surfactant is an important factor in addition to the composition of the grease composition.

As an example, in a friction and wear test (between metal and resin) of a grease composition containing specific base oils and thickeners, and an extreme pressure additive, the blending amount of the fluorine-based surfactant was variously changed (from 0 to 3 mass %). The results of the friction and wear test of the grease composition are shown in FIG. 7.

Figure 7:
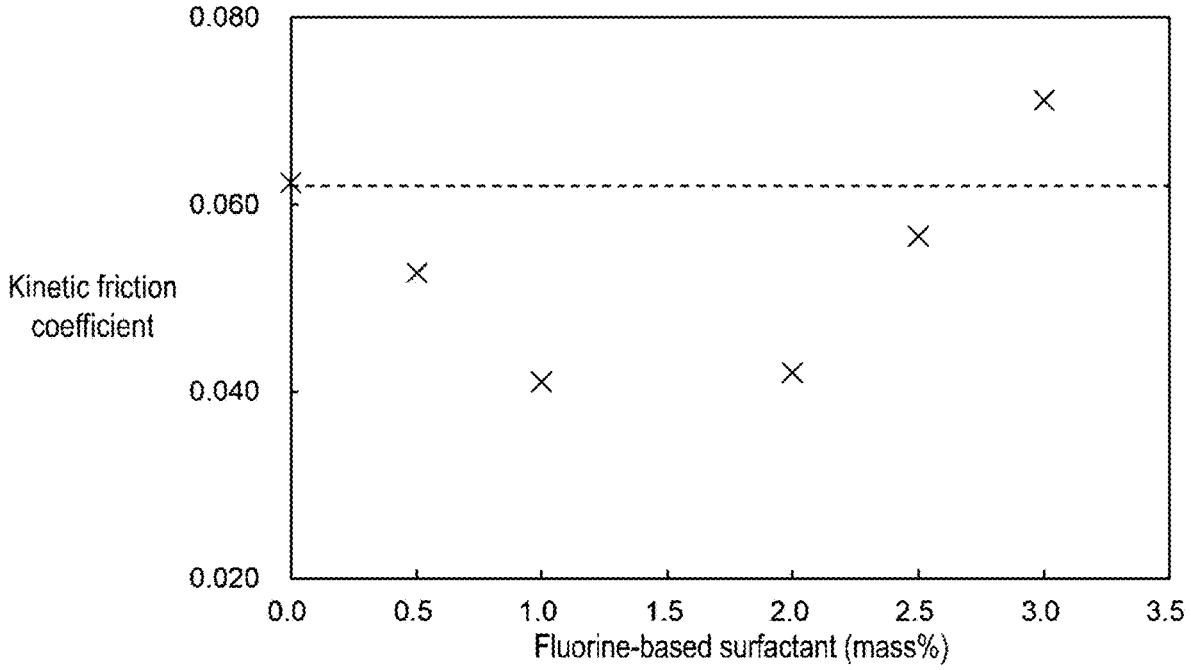
FIG. 7 is a graph showing results (kinetic friction coefficient values) of a friction and wear test of grease compositions of Comparative Example 2, Example 6, Example 5, Example 2, Example 7, and Comparative Example 6 with a blending amount of a fluorine-based surfactant from 0 mass % to 3 mass %.

As shown in FIG. 7, the results confirmed that when the fluorine-based surfactant was not blended, the kinetic friction coefficient value between metal and resin slightly exceeded 0.060 (0.061) but blending the fluorine-based surfactant reduced the kinetic friction coefficient value. However, the results confirmed that when the blending amount was 3 mass %, the kinetic friction coefficient value sharply increased to a higher value (0.071) than the value when the surfactant was not blended.

The fluorine-based surfactant can thus be used in an amount from 0.1 to 2.5 mass %, preferably from 0.5 to 2.5 mass %, for example, from 1 to 2 mass % relative to the total mass of the grease composition.

Extreme Pressure Additive

The grease for resin lubrication of the disclosure contains an extreme pressure additive (extreme pressure agent).

Extreme pressure additives are known to have a function of reacting with a metal surface to form a lubricating film and thereby reducing friction and wear of the metal surface and preventing seizure of the metal surface. Thus, the grease for resin lubrication containing an extreme pressure additive may be considered to have no effect on a sliding surface made of resin, but the present inventors have found that the friction coefficient decreases also when the grease for resin lubrication containing an extreme pressure additive is applied to a resin sliding surface.

Examples of the extreme pressure additive include phosphorus-based compounds, sulfur-based compounds, chlorine-based compounds, metal salts of sulfur-based compounds, and polymeric esters.

Among these, in the disclosure, at least one of the phosphorus-based compounds (phosphorus-based additives) and the polymeric esters (polymeric ester-based additives) is preferably used as the extreme pressure additive, and these may be used in various combinations.

Examples of the phosphorus-based additive include phosphate esters, phosphite esters, phosphate ester amine salts, and thiophosphate esters.

Examples of the suitable phosphorus-based additive include phosphate triesters, such as tricresyl phosphate (TCP), triphenyl phosphate, tributyl phosphate, trioctyl phosphate, and trioleil phosphate; and thiophosphate triesters, such as triphenoxyphosphine sulfide (TPPS), and these are also commercially available.

In addition, examples of the polymeric ester include esters of an aliphatic monovalent carboxylic acid and divalent carboxylic acid with a polyhydric alcohol. Specific examples of the polymeric ester include, but are not limited to, PERFAD (trademark) series and PRIOLUBE (trademark) series available from Croda Japan K.K.

The extreme pressure additive can be used in an amount of 0.005 to 10 mass %, preferably of 0.01 to 5 mass %, for example, of 0.01 to 1 mass % relative to the total mass of the grease composition.

Additional Additive

Furthermore, in addition to the essential components described above, the grease composition for resin lubrication can contain an additive normally used in grease compositions as necessary within a range not impairing the effects of the disclosure.

Examples of such an additive include antioxidants, metal deactivators, rust inhibitors, oiliness improvers, viscosity index improvers, and thickening agents.

When the additional additive is contained, the added amount (total amount) is typically from 0.1 to 10 mass % relative to the total mass of the grease composition.

Examples of the antioxidant include hindered phenol-based antioxidants, such as octadecyl-3-(3,5-di-t-butyl-4-hydroxyphenyl)propionate, pentaerythritol tetrakis[3-(3,5-di-t-butyl-4-hydroxyphenyl)propionate], 2,4-bis-(n-octylthio)-6-(4-hydroxy-3,5-di-t-butylanilino)-1,3,5-triazine, 1,3,5-trimethyl-2,4,6-tris(3,5-di-t-butyl-4-hydroxybenzyl)benzene, triethylene glycol-bis[3-(3-t-butyl-5-methyl-4-hydroxyphenyl)propionate], 1,6-hexanediol-bis[3-(3,5-di-t-butyl-4-hydroxyphenyl)propionate], 2,2-thiodiethylenebis[3-(3,5-di-t-butyl-4-hydroxyphenyl)propionate], and N,N'-hexamethylenebis(3,5-di-t-butyl-4-hydroxy-hydrocinnamide); phenol-based antioxidants, such as 2,6-di-t-butyl-4-methylphenol and 4,4-methylenebis(2,6-di-t-butylphenol); and amine-based antioxidants, such as triphenylamine, phenyl-α-naphthylamine, alkylated phenyl-α-naphthylamine, phenothiazine, and alkylated phenothiazine.

Examples of the metal deactivator include benzotriazole and sodium nitrite.

The grease composition for resin lubrication of the disclosure can be obtained by mixing the various base oils, the various thickeners, the fluorine-based surfactant, and the extreme pressure additive to give predetermined proportions, and blending the additional additive as desired.

In addition, the grease composition for resin lubrication can also be obtained by blending two base greases of a fluorine-based grease composed of the fluorine-based base oil and the fluorine-based thickener, and the lithium soap grease (or the lithium complex soap grease) composed of the synthetic hydrocarbon oil and the lithium soap thickener (or the lithium complex soap thickener); the fluorine-based surfactant; and the extreme pressure additive; as well as the additional additive as desired. Alternatively, the grease composition for resin lubrication may be obtained by blending one of the base greases, the remaining base oil, the thickener, the fluorine-based surfactant, and the extreme pressure additive, as well as the additional additive as desired.

Typically, the content of the thickener relative to the base grease is approximately from 10 to 30 mass %, and for example, in the two base greases, the content of each thickener relative to each base grease can be from 15 to 30 mass % for the fluorine-based thickener and from 10 to 20 mass % for one of the lithium soap or lithium complex soap thickener.

In addition, the blending ratio (mass ratio, total 100) of the two base greases, for example, the fluorine-based grease to one of the lithium soap grease or the lithium complex soap grease can be from 99 to 60:from 1 to 40, for example, from 98 to 70:from 2 to 30, from 98 to 75:from 2 to 25, from 98 to 80:from 2 to 20, from 98 to 85:from 2 to 15, or from 98 to 90:from 2 to 10.

The grease composition for resin lubrication of the disclosure is applied to a sliding surface made of resin and thus is a relatively soft grease, and the mixed consistency can be in a range of 265 to 340, for example.

The disclosure is not limited to the embodiments and specific examples described in the present specification, and various modifications and variations are possible within the scope of the technical ideas described in the claims.

EXAMPLES

Hereinafter, the disclosure will be described in further detail with examples. However, the disclosure is not limited to these examples.

Evaluation of Grease Composition For Resin Lubrication

The grease compositions used in Examples 1 to 12 and Comparative Examples 1 to 10 were prepared with the blending amounts shown in each table below.

The details and abbreviation of each component used in the preparation of the grease are as follows.

(a) Base oil (a1) Fluorine-based base oil: linear perfluoropolyether (PFPE) oil (a1-1) Linear PFPE oil 1 (kinematic viscosity at 40° C.: 392 $mm^2/s$)

(a1-2) Linear PFPE oil 2 (kinematic viscosity at 40° C.: 300 $mm^2/s$)

(a1-3) Linear PFPE oil 3 (kinematic viscosity at 40° C.: 200 $mm^2/s$)

(a2) Synthetic hydrocarbon oil: polyalphaolefin (PAO)

(a2-1) PAO1 (kinematic viscosity at 40° C.: 30 $mm^2/s$)

(a2-2) PAO2 (kinematic viscosity at 40° C.: 100 $mm^2/s$)

(a2-3) PAO3 (kinematic viscosity at 40° C.: 200 $mm^2/s$)

(a2-4) PAO4 (kinematic viscosity at 40° C.: 18 $mm^2/s$)

(a2-5) PAO5 (kinematic viscosity at 40° C.: 300 $mm^2/s$)

(b) Thickener (b1) Fluorine-based thickener: PTFE (polytetrafluoroethylene) resin (particle size 1000 nm)

(b2) Li soap thickener: 12OHLi soap (lithium 12-hydroxystearate)

(c) Additive (c1) Fluorine-based surfactant: fluorine-containing phosphate ester, product name "MEGAFACE F-510"

(c2) Extreme pressure additive: tricresyl phosphate (TCP), product name "Tritolyl Phosphate", available from FUJIFILM Wako Pure Chemical Corporation (c3) Antioxidant: diarylamine-based antioxidant, product name "IRGANOX L57", BASF Japan Ltd.

Properties of the resulting grease compositions, such as lubricating properties between metal and resin (friction and wear test (1)) and lubricating properties between resins (between a resin pin and a resin) (friction and wear test (2)) were evaluated by the following procedures.

Test Methods

Figure 4:
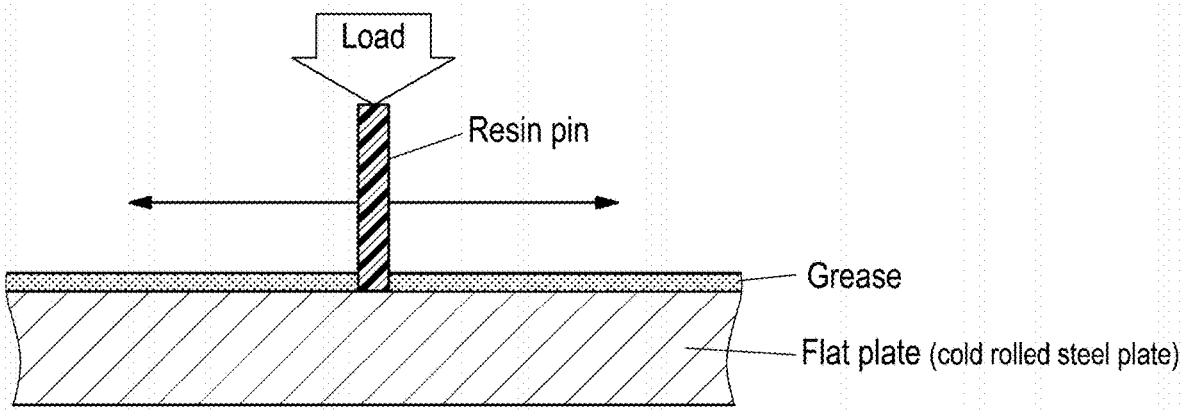
FIG. 4 is a conceptual diagram of a device used in a friction and wear test (1) (evaluation of lubricating properties between metal and resin) performed in Examples.

1. Evaluation of Lubricating Properties Between Metal and Resin: Friction and Wear Test (1) Kinetic Friction Coefficient As illustrated in a conceptual diagram of a friction and wear test illustrated in FIG. 4, each grease composition was applied onto a flat plate (cold rolled steel plate) to form a laminate sample. On the surface of the flat plate (cold rolled steel plate) of the laminate sample, a probe (resin pin) was slid with a predetermined load, and the friction coefficient when the probe was moving at a constant speed was measured. The measurements were performed during a five-stroke sliding cycle, and the average value of the obtained values was taken as the kinetic friction coefficient in each measurement.

Each grease composition of Examples and Comparative Examples was tested three times, and the average value of the three measurements was taken as the kinetic friction coefficient of each grease composition, and the lubricating properties were evaluated according to the evaluation criteria shown below.

Test Conditions

Measuring device: Variable Normal Load Friction and Wear Measurement System HHS2000 available from Shinto Scientific Co., Ltd.

Measurement conditions: tested in air

Probe: resin pin (pin diameter, 2.5 mm; pin type, PPA resin)

Feed scale: 10 mm

Load: 50 g

Sliding speed: 0.5 mm/sec

Sliding cycle: 5 strokes

Evaluation Criteria

In the test conditions of the present examples, lower kinetic friction coefficient indicates superior lubricating properties.

Previous findings have confirmed that when the kinetic friction coefficient value exceeds 0.060, the click operation deteriorates in an actual switch, and thus the value of 0.060 or less is determined to be appropriate.

A (appropriate): The kinetic friction coefficient was 0.060 or less.

N (not appropriate): The kinetic friction coefficient was greater than 0.060.

Figure 5:
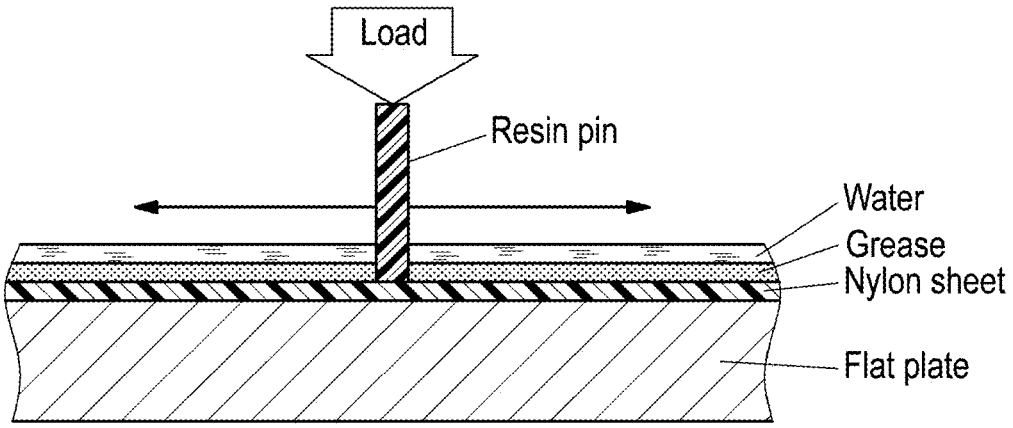
FIG. 5 is a conceptual diagram of a device used in a friction and wear test (2) (evaluation of lubricating properties between resins) performed in Examples.

2. Evaluation of Lubricating Properties Between Resins: Friction and Wear Test (2) Static Friction Coefficient As illustrated in a conceptual diagram of a friction and wear test illustrated in FIG. 5, a nylon sheet was provided on a flat plate, each grease composition was applied onto the nylon sheet to form a laminate sample, and the laminate sample was immersed in water. On the surface of the nylon sheet of this laminate sample in the immersed state in water, a probe (resin pin) was slid with a predetermined load, and the friction coefficient at that time was measured. The measurements were performed during a 200-stroke sliding cycle, and the maximum value of the obtained values was taken as the static friction coefficient in each measurement (the highest friction coefficient corresponds to a static friction coefficient at the moment when the probe starts moving or stops moving).

Each grease composition of Examples and Comparative Examples was tested three times, and the average value of the three measurements was taken as the static friction coefficient of each grease composition, and the lubricating properties were evaluated according to the evaluation criteria shown below.

Test Conditions

Measuring device: Variable Normal Load Friction and Wear Measurement System HHS2000 available from Shinto Scientific Co., Ltd.

Measurement conditions: tested in water

Probe: resin pin (pin diameter, 2.5 mm; pin type, PPA resin)

Feed scale: 3 mm

Load: 1000 g

Sliding speed: 1.0 mm/sec

Sliding cycle: 200 strokes

Evaluation Criteria

In the test conditions of the present examples, lower static friction coefficient indicates superior lubricating properties.

Previous findings have confirmed that when the static friction coefficient value exceeds 0.120, a tear occurs in the waterproof film in an actual switch, and thus the value of 0.120 or less is determined to be appropriate.

A (appropriate): The static friction coefficient was 0.120 or less.

N (not appropriate): The static friction coefficient was greater than 0.120.

The results are shown in Table 1 and Table 2. The "Blending amount: mass %" in the tables is a value relative to the total mass of the composition (however, the value is rounded to two decimal places, and thus the total may not be 100 mass %). In the tables, the fluorine-based base oil and the fluorine-based thickener are collectively described as "fluorine-based grease", and the synthetic hydrocarbon oil and the lithium soap thickener are collectively described as "Li soap grease".

Figure 6A:
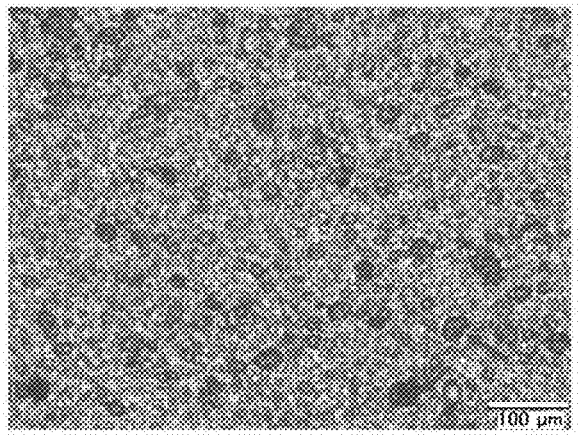
FIGS. 6A and 6B are microscopic observation photographs (magnification of 200 times) of grease compositions of Comparative Example 2 (FIG. 6A) and Example 2 (FIG. 6B).
Figure 6B:
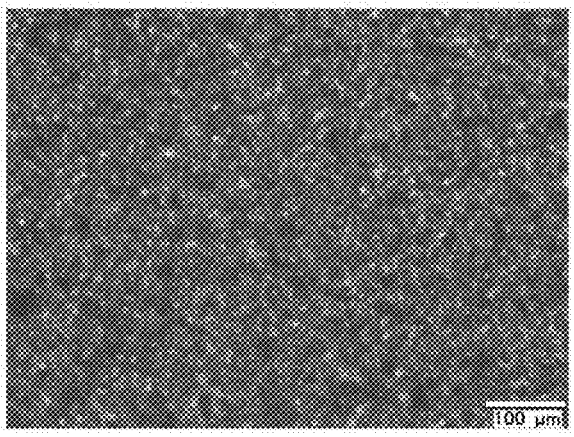

In addition, FIGS. 6A and 6B show micrographs of the grease compositions of Comparative Example 2 (FIG. 6A) and Example 2 (FIG. 6B), and FIG. 7 is a graph showing the results (kinetic friction coefficient values) of the friction and wear test of grease compositions of Comparative Example 2, Example 6, Example 5, Example 2, Example 7, and Comparative Example 6 with a blending amount of a fluorine-based surfactant of 0 mass % to 3 mass %.

Figure 8:
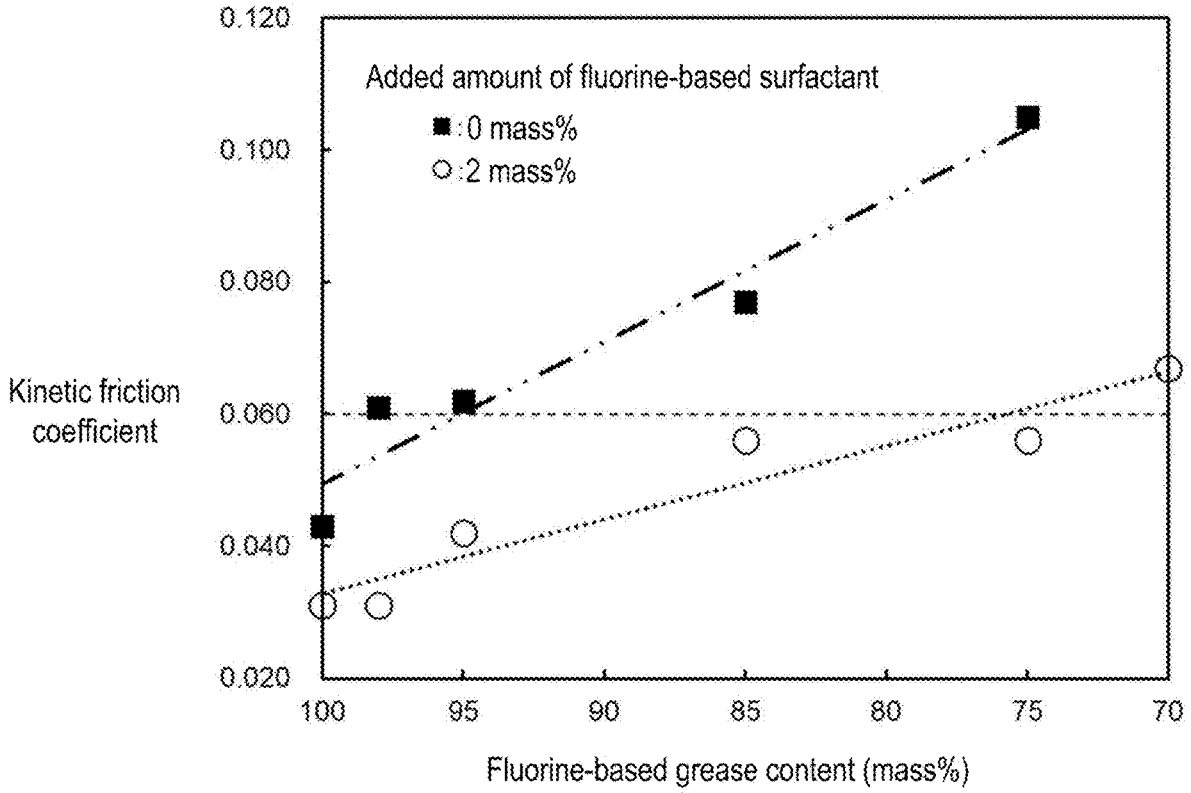
FIG. 8 is a graph showing results (kinetic friction coefficient values) of a friction and wear test where the proportion of the total amount of a fluorine-based base oil and a fluorine-based thickener (referred to as "Fluorine-based grease content" in the graph) was changed from 100 mass % to 70 mass % when a total mass of a fluorine-based base oil, a synthetic hydrocarbon oil, a fluorine-based thickener, and a lithium soap thickener was 100 in grease compositions with an added amount of a fluorine-based surfactant of 2 mass % (○: Comparative Example 9, Examples 1 to 4, and Comparative Example 10) and in grease compositions with an added amount of a fluorine-based surfactant of 0 mass % (■: Comparative Example 7 and Comparative Examples 1 to 4).

FIG. 8 is a graph showing the results (kinetic friction coefficient values) of the friction and wear test where a proportion of the total amount of the fluorine-based base oil and the fluorine-based thickener (referred to as "Fluorine-based grease content" in the graph) was changed from 100 mass % to 70 mass % when the total mass of the fluorine-based base oil, the synthetic hydrocarbon oil, the fluorine-based thickener, and the lithium soap thickener was 100 in the grease compositions with an added amount of the fluorine-based surfactant of 2 mass % (○: Comparative Example 9, Examples 1 to 4, and Comparative Example 10) and in the grease compositions with an added amount of the fluorine-based surfactant of 0 mass % (■: Comparative Example 7 and Comparative Examples 1 to 4).

Figure 9:
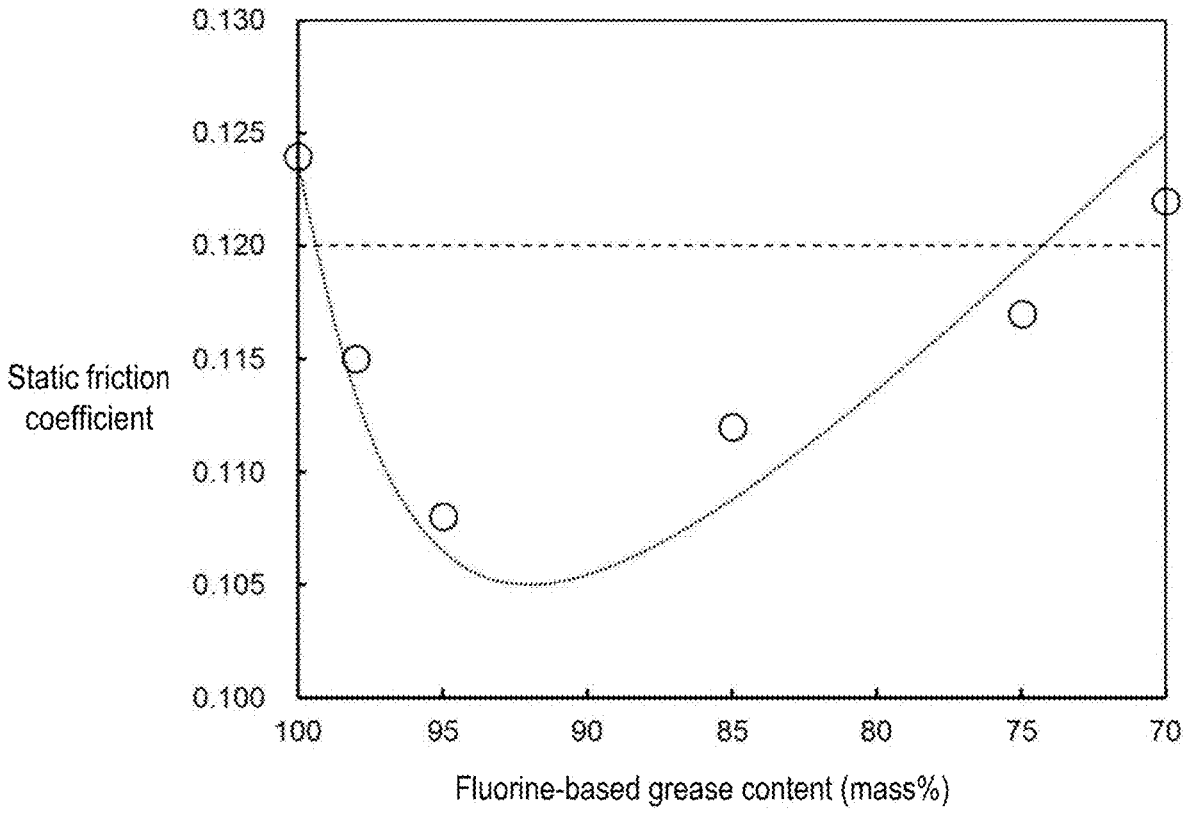
FIG. 9 is a graph showing results (static friction coefficient values) of a friction and wear test, where the proportion of the total amount of a fluorine-based base oil and a fluorine-based thickener (referred to as "Fluorine-based grease content" in the graph) was changed from 100 mass % to 70 mass % when a total mass of a fluorine-based base oil, a synthetic hydrocarbon oil, a fluorine-based thickener, and a lithium soap thickener was 100 in grease compositions of Comparative Example 9, Examples 1 to 4, and Comparative Example 10.

Furthermore, FIG. 9 is a graph showing the results (static friction coefficient values) of the friction and wear test where a proportion of the total amount of the fluorine-based base oil and the fluorine-based thickener (referred to as "Fluorine-based grease content" in the graph) was changed from 100 mass % to 70 mass % when the total mass of the fluorine-based base oil, the synthetic hydrocarbon oil, the fluorine-based thickener, and the lithium soap thickener was 100 in the grease compositions of Comparative Example 9, Examples 1 to 4, and Comparative Example 10.

TABLE 1

| (Blending amount: mass %) | | | Examples 1 | 2 | 3 | 4 | 5 | 6 |
|---|---|---|---|---|---|---|---|---|
| Base oil | (a1) Fluorine-based | (a1-1) Linear PFPE oil 1 (392 $mm^2/s$)*1 | 66.54 | 64.51 | 57.72 | 50.93 | 65.17 | 65.50 |
| | | (a1-2) Linear PFPE oil 2 (300 $mm^2/s$)*1 | | | | | | |
| | | (a1-3) Linear PFPE oil 3 (200 $mm^2/s$)*1 | | | | | | |
| | (a2) Synthetic hydrocarbon oil | (a2-1) PAO1 (30 $mm^2/s$)*1 | | | | | | |
| | | (a2-2) PAO2 (100 $mm^2/s$)*1 | 1.70 | 4.24 | 12.73 | 21.22 | 4.29 | 4.31 |
| | | (a2-4) PAO3 (200 $mm^2/s$)*1 | | | | | | |
| | | (a2-5) PAO4 (18 $mm^2/s$)*1 | | | | | | |
| | | (a2-6) PAO5 (300 $mm^2/s$)*1 | | | | | | |
| Thickener | (b1) Fluorine-based | PTFE resin | 28.52 | 27.65 | 24.74 | 21.83 | 27.93 | 28.07 |
| | (b2) Li soap | Lithium soap | 0.24 | 0.61 | 1.82 | 3.03 | 0.61 | 0.62 |
| Additive | (c1) Fluorine-based surfactant | Fluorine-containing phosphate ester | 2.00 | 2.00 | 2.00 | 2.00 | 1.00 | 0.50 |
| | (c2) Extreme pressure additive | Tricresyl phosphate (TCP) | 0.04 | 0.10 | 0.29 | 0.49 | 0.10 | 0.10 |
| | (c3) Additional | Antioxidant | 0.96 | 0.90 | 0.71 | 0.52 | 0.90 | 0.90 |
| Fluorine-based grease [(a1) + (b1)]:Li soap grease [(a2) + (b2)] (mass ratio) | | | 98:2 | 95:5 | 85:15 | 75:25 | 95:5 | 95:5 |
| Evaluation results | Evaluation of lubricating properties (1) | Kinetic friction coefficient (measured) | 0.031 | 0.042 | 0.056 | 0.056 | 0.041 | 0.053 |
| | Between metal and resin | Evaluation*2 | A | A | A | A | A | A |
| | Evaluation of lubricating properties (2) | Static friction coefficient (measured) | 0.115 | 0.108 | 0.112 | 0.117 | 0.103 | 0.105 |
| | Between resin pin and film | Evaluation*3 | A | A | A | A | A | A |

| (Blending amount: mass %) | | | Examples 7 | 8 | 9 | 10 | 11 | 12 |
|---|---|---|---|---|---|---|---|---|
| Base oil | (a1) Fluorine-based | (a1-1) Linear PFPE oil 1 (392 $mm^2/s$)*1 | 64.17 | | 65.17 | 65.17 | 65.17 | 65.17 |
| | | (a1-2) Linear PFPE oil 2 (300 $mm^2/s$)*1 | | 65.17 | | | | |
| | | (a1-3) Linear PFPE oil 3 (200 $mm^2/s$)*1 | | | | | | |
| | (a2) Synthetic hydrocarbon oil | (a2-1) PAO1 (30 $mm^2/s$)*1 | | | 4.29 | | | |
| | | (a2-2) PAO2 (100 $mm^2/s$)*1 | 4.22 | 4.29 | | | | |
| | | (a2-4) PAO3 (200 $mm^2/s$)*1 | | | | 4.29 | | |
| | | (a2-5) PAO4 (18 $mm^2/s$)*1 | | | | | 4.29 | |
| | | (a2-6) PAO5 (300 $mm^2/s$)*1 | | | | | | 4.29 |
| Thickener | (b1) Fluorine-based | PTFE resin | 27.50 | 27.93 | 27.93 | 27.93 | 27.93 | 27.93 |
| | (b2) Li soap | Lithium soap | 0.60 | 0.61 | 0.61 | 0.61 | 0.61 | 0.61 |

TABLE 1-continued

| | | | | | | | | |
|---|---|---|---|---|---|---|---|---|
| Additive | (c1) Fluorine-based surfactant | Fluorine-containing phosphate ester | 2.50 | 1.00 | 1.00 | 1.00 | 1.00 | 1.00 |
| | (c2) Extreme pressure additive | Tricresyl phosphate (TCP) | 0.10 | 0.10 | 0.10 | 0.10 | 0.10 | 0.10 |
| | (c3) Additional | Antioxidant | 0.90 | 0.90 | 0.90 | 0.90 | 0.90 | 0.90 |
| Fluorine-based grease [(a1) + (b1)]:Li soap grease [(a2) + (b2)] (mass ratio) | | | 95:5 | 95:5 | 95:5 | 95:5 | 95:5 | 95:5 |
| Evaluation results | Evaluation of lubricating properties (1) | Kinetic friction coefficient (measured) | 0.057 | 0.053 | 0.058 | 0.053 | 0.057 | 0.058 |
| | Between metal and resin | Evaluation*2 | A | A | A | A | A | A |
| | Evaluation of lubricating properties (2) | Static friction coefficient (measured) | 0.105 | 0.112 | 0.103 | 0.105 | 0.103 | 0.104 |
| | Between resin pin and film | Evaluation*3 | A | A | A | A | A | A |

Note:

*1Values in parentheses indicate kinematic viscosity at 40° C.

*2A (appropriate): The kinetic friction coefficient was 0.060 or less. N (not appropriate): The kinetic friction coefficient was greater than 0.060.

*3A (appropriate): The static friction coefficient was 0.120 or less. N (not appropriate): The static friction coefficient was greater than 0.120.

TABLE 2

| | | | Comparative Examples | | | | |
|---|---|---|---|---|---|---|---|
| (Blending amount: mass %) | | | 1 | 2 | 3 | 4 | 5 |
| Base oil | (a1) Fluorine-based | (a1-1) Linear PFPE oil 1 (392 $mm^2/s$)*1 | 67.91 | 65.84 | 58.91 | 51.98 | |
| | | (a1-2) Linear PFPE oil 2 (300 $mm^2/s$)*1 | | | | | |
| | | (a1-3) Linear PFPE oil 3 (200 $mm^2/s$)*1 | | | | | 65.17 |
| | (a2) Synthetic hydrocarbon oil | (a2-1) PAO1 (30 $mm^2/s$)*1 | | | | | |
| | | (a2-2) PAO2 (100 $mm^2/s$)*1 | 1.73 | 4.33 | 12.99 | 21.66 | 4.29 |
| | | (a2-4) PAO3 (200 $mm^2/s$)*1 | | | | | |
| | | (a2-5) PAO4 (18 $mm^2/s$)*1 | | | | | |
| | | (a2-6) PAO5 (300 $mm^2/s$)*1 | | | | | |
| Thickener | (b1) Fluorine-based | PTFE resin | 29.11 | 28.22 | 25.25 | 22.28 | 27.93 |
| | (b2) Li soap | Lithium soap | 0.25 | 0.62 | 1.86 | 3.09 | 0.61 |
| Additive | (c1) Fluorine-based surfactant | Fluorine-containing phosphate ester | 0 | 0 | 0 | 0 | 1.00 |
| | (c2) Extreme pressure additive | Tricresyl phosphate (TCP) | 0.04 | 0.10 | 0.29 | 0.49 | 0.10 |
| | (c3) Additional | Antioxidant | 0.96 | 0.90 | 0.71 | 0.51 | 0.90 |
| Fluorine-based grease [(a1) + (b1)]:Li soap grease [(a2) + (b2)] (mass ratio) | | | 98:2 | 95:5 | 85:15 | 75:25 | 95:5 |
| Evaluation results | Evaluation of lubricating properties (1) | Kinetic friction coefficient (measured) | 0.061 | 0.062 | 0.077 | 0.105 | 0.067 |
| | Between metal and resin | Evaluation*2 | N | N | N | N | N |
| | Evaluation of lubricating properties (2) | Static friction coefficient (measured) | 0.103 | 0.098 | 0.104 | 0.109 | — |
| | Between resin pin and film | Evaluation*3 | A | A | A | A | — |

| | | | Comparative Examples | | | | |
|---|---|---|---|---|---|---|---|
| (Blending amount: mass %) | | | 6 | 7 | 8 | 9 | 10 |
| Base oil | (a1) Fluorine-based | (a1-1) Linear PFPE oil 1 (392 $mm^2/s$)*1 | 63.84 | 70.00 | | 68.60 | 47.53 |
| | | (a1-2) Linear PFPE oil 2 (300 $mm^2/s$)*1 | | | | | |
| | | (a1-3) Linear PFPE oil 3 (200 $mm^2/s$)*1 | | | 80.00 | | |
| | (a2) Synthetic hydrocarbon oil | (a2-1) PAO1 (30 $mm^2/s$)*1 | | | | | |
| | | (a2-2) PAO2 (100 $mm^2/s$)*1 | 4.20 | | | | 25.46 |
| | | (a2-4) PAO3 (200 $mm^2/s$)*1 | | | | | |
| | | (a2-5) PAO4 (18 $mm^2/s$)*1 | | | | | |
| | | (a2-6) PAO5 (300 $mm^2/s$)*1 | | | | | |
| Thickener | (b1) Fluorine-based | PTFE resin | 27.36 | 30.00 | 20.00 | 29.40 | 20.37 |
| | (b2) Li soap | Lithium soap | 0.60 | | | | 3.64 |
| Additive | (c1) Fluorine-based surfactant | Fluorine-containing phosphate ester | 3.00 | 0 | 0 | 2.0 | 2.0 |
| | (c2) Extreme pressure additive | Tricresyl phosphate (TCP) | 0.10 | | | | 0.58 |
| | (c3) Additional | Antioxidant | 0.90 | | | | 0.42 |
| Fluorine-based grease [(a1) + (b1)]:Li soap grease [(a2) + (b2)] (mass ratio) | | | 95:5 | 100:0 | 100:0 | 100:0 | 70:30 |

TABLE 2-continued

| | | | | | | | |
|---|---|---|---|---|---|---|---|
| Evaluation results | Evaluation of lubricating properties (1) | Kinetic friction coefficient (measured) | 0.071 | 0.043 | 0.084 | 0.031 | 0.067 |
| | Between metal and resin | Evaluation*2 | N | A | N | A | N |
| | Evaluation of lubricating properties (2) | Static friction coefficient (measured) | — | 0.135 | 0.146 | 0.124 | 0.122 |
| | Between resin pin and film | Evaluation*3 | — | N | N | N | N |

Note:
*1Values in parentheses indicate kinematic viscosity at 40° C.
*2A (appropriate): The kinetic friction coefficient was 0.060 or less. N (not appropriate): The kinetic friction coefficient was greater than 0.060.
*3A (appropriate): The static friction coefficient was 0.120 or less. N (not appropriate): The static friction coefficient was greater than 0.120.

FIGS. 6A and 6B are microscopic observation photographs of the grease compositions of Comparative Example 2 (FIG. 6A) and Example 2 (FIG. 6B). As illustrated in FIGS. 6A and 6B, many aggregates with a size approximately from 20 to 30 μm were observed in the grease composition containing no surfactant (FIG. 6A) compared to the grease composition containing a surfactant (FIG. 6B). The presence of the aggregates is considered to have led to the increase in the friction coefficients (kinetic friction coefficient and static friction coefficient) at the sliding surface.

FIG. 7 is a graph showing the results (kinetic friction coefficient values) of the friction and wear test of the grease compositions where the blending amount of the fluorine-based surfactant was changed from 0 mass % to 3 mass % in the grease compositions (Comparative Example 2, Example 6, Example 5, Example 2, Example 7, and Comparative Example 6).

The horizontal axis of the graph shown in FIG. 7 indicates the blending amount (mass %) of the fluorine-based surfactant in the grease composition, and the vertical axis indicates measured values of the kinetic friction coefficient. The dashed line drawn parallel to the horizontal axis in FIG. 7 indicates a kinetic friction coefficient value of 0.060.

As shown in FIG. 7, the results confirmed that when the fluorine-based surfactant was not blended, the kinetic friction coefficient value between metal and resin slightly exceeded 0.060 (0.061) but blending the fluorine-based surfactant reduced the kinetic friction coefficient value to below 0.060. However, the results confirmed that when the blending amount was 3 mass %, the kinetic friction coefficient value sharply increased to a higher value (0.071) than the value when the surfactant was not blended.

FIG. 8 is a graph showing the results (kinetic friction coefficient values) of the friction and wear test in the grease compositions with an added amount of the fluorine-based surfactant of 2 mass % (○: Comparative Example 9, Examples 1 to 4, and Comparative Example 10) and in the grease compositions with an added amount of the fluorine-based surfactant of 0 mass % (■: Comparative Example 7 and Comparative Examples 1 to 4) where a proportion of the total amount of the fluorine-based base oil and the fluorine-based thickener (referred to as "Fluorine-based grease content" in the graph) was changed from 100 mass % to 70 mass % when the total mass of the fluorine-based base oil, the synthetic hydrocarbon oil, the fluorine-based thickener, and the lithium soap thickener was 100.

The horizontal axis of the graph shown in FIG. 8 indicates a proportion (mass %) of the total amount of the fluorine-based base oil and the fluorine-based thickener when the total mass of the fluorine-based base oil, the synthetic hydrocarbon oil, the fluorine-based thickener, and the lithium soap thickener is 100, and the vertical axis indicates measured values of the kinetic friction coefficient. The dashed line drawn parallel to the horizontal axis in FIG. 8 indicates a kinetic friction coefficient value of 0.060.

As shown in FIG. 8, the results found that the value of the kinetic friction coefficient tended to increase with decrease in the proportion of the total amount of the fluorine-based base oil and the fluorine-based thickener with the added amount of the fluorine-based surfactant of either 2 mass % (indicated by ○ in the graph) or 0 mass % (indicated by ■ in the graph).

With the added amount of the fluorine-based surfactant of 2 mass % (○), the kinetic friction coefficient between resin and metal resulted in falling below 0.060 when the proportion of the total amount of the fluorine-based base oil and the fluorine-based thickener was in the range of 100 mass % (i.e., when the synthetic hydrocarbon oil and the lithium soap thickener were not blended) to 75 mass %. On the other hand, with the added amount of the fluorine-based surfactant of 0 mass % (■), the kinetic friction coefficient fell below 0.060 when the proportion of the total amount of the fluorine-based base oil and the fluorine-based thickener was 100 mass %, but blending the synthetic hydrocarbon oil and the lithium soap thickener resulted in a value of the kinetic friction coefficient exceeding 0.060.

FIG. 9 is a graph showing the results (static friction coefficient values) of the friction and wear test in the grease compositions (Comparative Example 9, Examples 1 to 4, and Comparative Example 10) where a proportion of the total amount of the fluorine-based base oil and the fluorine-based thickener (referred to as "Fluorine-based grease content" in the graph) was changed from 100 mass % to 70 mass % when the total mass of the fluorine-based base oil, the synthetic hydrocarbon oil, the fluorine-based thickener, and the lithium soap thickener was 100.

The horizontal axis of the graph shown in FIG. 9 indicates a proportion (mass %) of the total amount of the fluorine-based base oil and the fluorine-based thickener when the total mass of the fluorine-based base oil, the synthetic hydrocarbon oil, the fluorine-based thickener, and the lithium soap thickener is 100, and the vertical axis indicates measured values of the static friction coefficient. The dashed line drawn parallel to the horizontal axis in FIG. 9 indicates a static friction coefficient value of 0.120.

As shown in FIG. 9, the grease composition resulted in a static friction coefficient between resins exceeding 0.120 when the proportion of the total amount of the fluorine-based base oil and the fluorine-based thickener was 100 mass % (i.e., when the synthetic hydrocarbon oil and the lithium soap thickener were not blended). The results confirmed that blending the synthetic hydrocarbon oil and the lithium soap thickener to the grease composition sharply reduced the static friction coefficient value, and the static friction coefficient value tended to fall below 0.120. However, increasing the blending amount of the synthetic hydrocarbon oil and the lithium soap thickener to a proportion of the total amount of the fluorine-based base oil and the fluorine-based thickener of 70 mass % resulted in a value of the static friction coefficient exceeding 0.120 again.

As shown in Table 1, all the grease compositions of Examples 1 to 12 resulted in a kinetic friction coefficient of 0.060 or less and a static friction coefficient of 0.120 or less, confirming excellent lubricating properties both between metal and resin and between resins.

In addition, as shown in Example 5 and Example 8, using the fluorine-based base oil with a kinematic viscosity at 40° C. in a range of 300 $mm^2/s$ or higher resulted in excellent lubricating properties, and using the fluorine-based base oil with a kinematic viscosity of 390 $mm^2/s$ or higher (Example 5) resulted in even better lubricating properties.

Furthermore, as shown in Example 2 and Examples 5 to 7, changing the blending proportion of the fluorine-based surfactant from 0.5 mass % to 2.5 mass % resulted in excellent lubricating properties.

Moreover, as shown in Examples 1 to 4, changing the mass ratio [A]:[B] of the total amount [A] of the fluorine-based base oil (a1) and the fluorine-based thickener (b1) to the total amount [B] of the synthetic hydrocarbon oil (a2) and the lithium soap thickener (b2) from 98:2 to 75:25 also resulted in excellent lubricating properties.

As shown in Example 5 and Examples 8 to 12, using the synthetic hydrocarbon oil with a kinematic viscosity at 40° C. in a range within 18 to 200 $mm^2/s$ also resulted in excellent lubricating properties.

On the other hand, as shown in Table 2, for the grease compositions of Comparative Examples 1 to 4 containing no fluorine-based surfactant, the static friction coefficient was low (0.109 or less), but the kinetic friction coefficient deteriorated (from 0.061 to 0.105), resulting in poor lubricating properties between metal and resin compared to the grease compositions of the Examples. The grease compositions of Examples 1 to 4 had a kinetic friction coefficient of 0.060 or less (from 0.031 to 0.056), and in view of this result, blending the fluorine-based surfactant is likely to reduce the kinetic friction coefficient by approximately from 30% to 50%.

In addition, also for the grease composition of Comparative Example 5 prepared using the fluorine-based base oil with a kinematic viscosity at 40° C. of less than 300 $mm^2/s$ (kinematic viscosity: 200 $mm^2/s$), the kinetic friction coefficient deteriorated (0.067), resulting in poor lubricating properties between metal and resin compared to the grease composition of the Examples.

On the other hand, the static friction coefficient deteriorated (0.124 or greater) in the grease compositions of Comparative Examples 7 to 9 prepared using only the fluorine-based base oil and the fluorine-based thickener but not using the synthetic hydrocarbon oil and the lithium soap thickener or the lithium complex soap thickener, and the extreme pressure additive.

In addition, in the grease composition of Comparative Example 6 with a blending amount of the fluorine-based surfactant of 3.0 mass %, the kinetic friction coefficient significantly deteriorated compared to the grease composition of Example 2 (Example 2: 0.042, Comparative Example 6: 0.071) with a blending amount of the fluorine-based surfactant of 2.0 mass %, resulting in deteriorated lubricating properties between metal and resin.

Furthermore, in the grease composition of Comparative Example 10 with a mass ratio [A]:[B] of the total amount [A] of the fluorine-based base oil (a1) and the fluorine-based thickener (b1) to the total amount [B] of the synthetic hydrocarbon oil (a2) and the lithium soap thickener (b2) of 70:30, the kinetic friction coefficient increased compared to the grease composition of Example 4 (Example 4: 0.056, Comparative Example 10: 0.067) with a ratio [A]:[B] of 75:25, and the static friction coefficient also increased compared to the grease composition of Example 4 (Example 4: 0.117, Comparative Example 10: 0.122), confirming the decrease in lubricating properties both between metal and resin and between resins.

The results of Comparative Examples described above confirmed that, for the objects of the disclosure, to satisfy lubricating properties both between metal and resin and between resins, the blending amount of the fluorine-based surfactant is more suitably 3.0 mass % or less, and the mass ratio [A]:[B] of the total amount [A] of the fluorine-based base oil (a1) and the fluorine-based thickener (b1) to the total amount [B] of the synthetic hydrocarbon oil (a2) and the lithium soap thickener (b2) is more suitably from 98:2 to 75:25.

As described above, the results confirmed that the grease composition for resin lubrication of the disclosure containing the fluorine-based base oil and the synthetic hydrocarbon oil, the fluorine-based thickener and the lithium soap thickener, and the extreme pressure additive has excellent lubricating properties for the sliding surface, especially not only when the mating surface facing the sliding surface is made of resin but also when the mating surface is made of metal, and found that the application of the grease composition can provide resin sliding members and resin-metal sliding members capable of preventing friction and wear and extending product life.

The best embodiments have been described in detail above, but the disclosure is not limited to the embodiments described above, and variations, modifications, and the like within a range achieving the objects of the disclosure are included in the disclosure.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

The invention claimed is:

1. A grease composition for resin lubrication, the grease composition to be applied to a sliding surface made of resin, the grease composition comprising:

a fluorine-based base oil and a synthetic hydrocarbon oil;

a fluorine-based thickener, and one of a lithium soap thickener or a lithium complex soap thickener;

a fluorine-based surfactant, the fluorine-based surfactant is a fluorine-containing phosphate ester blended at 0.5 to 2.5 mass % relative to a total mass of the grease composition for resin lubrication; and an extreme pressure additive, wherein, the fluorine-based base oil has a kinematic viscosity at 40° C. of 300 $mm^2/s$ or higher and the grease composition has a kinetic friction coefficient below 0.060.

2. The grease composition for resin lubrication according to claim 1, wherein when a total mass of the fluorine-based base oil, the synthetic hydrocarbon oil, the fluorine-based thickener, and one of the lithium soap thickener or the lithium complex soap thickener is 100, a mass ratio [A]:[B] of a total amount [A] of the fluorine-based base oil and the fluorine-based thickener to a total amount [B] of the synthetic hydrocarbon oil and one of the lithium soap thickener or the lithium complex soap thickener is from 75:25 to 98:2.

3. The grease composition for resin lubrication according to claim 1, wherein at least a portion of a mating surface facing the sliding surface made of resin is a metal surface.

4. A resin sliding member comprising a sliding surface made of resin, the sliding surface provided by application with the grease composition for resin lubrication described in claim 1.

5. The resin sliding member according to claim 4, wherein the resin sliding member is a slide switch.

6. The resin sliding member according to claim 4, wherein the resin sliding member is a gear system.

7. A resin-metal sliding member comprising:

a sliding surface made of resin, the sliding surface provided by application with the grease composition for resin lubrication described in claim 1; and a metal mating surface facing the sliding surface.

8. The resin-metal sliding member according to claim 7, wherein the resin-metal sliding member is a slide switch.

9. The resin-metal sliding member according to claim 7, wherein the resin-metal sliding member is a gear system.

10. The grease composition for resin lubrication according to claim 1, wherein the fluorine-based base oil has the kinematic viscosity at 40° C. of 390 $mm^2/s$ or higher.

11. The grease composition for resin lubrication according to claim 1, wherein the extreme pressure additive is blended in an amount of 0.01 to 5 mass % relative to a total mass of the grease composition for resin lubrication.

12. The grease composition for resin lubrication according to claim 1, wherein the fluorine-based base oil includes a linear type perfluoropolyether.

13. The grease composition for resin lubrication according to claim 1, wherein the synthetic hydrocarbon oil includes polyalphaolefins (PAOs).

14. The grease composition for resin lubrication according to claim 1, wherein the fluorine-based thickener is a fluorine resin particle.

15. The grease composition for resin lubrication according to claim 1, wherein one of the lithium soap thickener or the lithium complex soap thickener is blended at 0.1 to 15 mass % relative to a total mass of the grease composition for resin lubrication.

16. The grease composition for resin lubrication according to claim 1, wherein the fluorine-based thickener and one of the lithium soap thickener or the lithium complex soap thickener is blended at 15 to 30 mass % relative to a total mass of the grease composition for resin lubrication.

17. The grease composition for resin lubrication according to claim 1, wherein the synthetic hydrocarbon oil has a kinematic viscosity at 40° C. in a range within 18 to 200 $mm^2/s$.

18. The grease composition for resin lubrication according to claim 1, wherein a ratio of the fluorine-based base oil to the synthetic hydrocarbon oil relative to a total amount of the fluorine-based base oil and the synthetic hydrocarbon oil of 100 mass % is from 98 to 65 mass %:from 2 to 35 mass %.

* * * * *